United States Patent [19]

Okada

[11] Patent Number: 4,508,345

[45] Date of Patent: Apr. 2, 1985

[54] SLOT MACHINE WITH PLAYER-FRIENDLY BONUS GAME

[75] Inventor: Kazuo Okada, Tokyo, Japan

[73] Assignee: Kabushiki Kaisha Universal, Tochigi, Japan

[21] Appl. No.: 488,533

[22] Filed: Apr. 20, 1983

[30] Foreign Application Priority Data

Apr. 26, 1982 [JP] Japan ..... 57-68641

[51] Int. Cl.[3] ..... A63F 5/04

[52] U.S. Cl. ..... 273/143 R

[58] Field of Search ..... 273/138 A, 143 R, 143 C, 273/1 E; 235/78 G

[56] References Cited

U.S. PATENT DOCUMENTS 4,099,722 7/1978 Rodesch et al. ..... 273/143 R 4,200,291 4/1980 Hooker ..... 273/143 R 4,299,388 11/1981 Resch et al. ..... 273/143 R 4,440,036 4/1984 Hooker et al. ..... 273/143 R

*Primary Examiner*—Richard C. Pinkham

*Assistant Examiner*—MaryAnn Lastova

*Attorney, Agent, or Firm*—Young & Thompson

[57] ABSTRACT

A slot machine has a plurality of rotatable reels with an annular series of symbols on the peripheral surfaces thereof. The reels rotate at high speed in an original game and at low speed in an immediately subsequent bonus game and can be brought to a stop, individually, by means of stop switches associated one with each of the reels. Therefore, in the bonus game, the player has an increased chance of causing a prize winning symbol or combination of symbols to appear in the windows in the selectively stopped positions of the reels.

2 Claims, 4 Drawing Figures

SLOT MACHINE WITH PLAYER-FRIENDLY BONUS GAME

BACKGROUND OF THE INVENTION

The present invention relates to slot machines of the type having a plurality of reels which are rotated at relatively low speed in a bonus game.

There are widely known many kinds of slot machines, one of which is provided with three to five rotatable reels arranged in side-by-side relationship. These reels are individually brought to a stop by pushing stop button switches associated with the respective reels. On the outer peripheral surface of each of the respective reels is printed or otherwise provided an annular series of spaced symbols such as a lemon, a cherry, a figure seven or the like; and three symbols on the respective reels in stopped position are shown in windows associated one with each reel. When any one of predetermined prize-winning combinations of symbols occurs on prize-winning lines, for instance three transverse lines and two diagonal lines, i.e., five lines in total, in the case of three reels, the slot machine causes the pay out of different numbers of coins or tokens (hereinafter, these are generically called tokens) as prizes in accordance with the combinations of symbols. The number of prize-winning lines available is one, for instance the central transverse line, if only one token has been inserted and is increased in proportion to the number of tokens inserted. Thus the probability of winning prizes depends on the number of tokens inserted.

There are conventionally provided several kinds of slot machines having various distinctive features, for example slot machines wherein all of the tokens therein are paid out when a combination of figures of seven (7) on the respective reels in stopped position occur in a prize-winning line; slot machines wherein tokens are paid out in proportion to the number of tokens inserted, and slot machines wherein a fixed number of tokens are paid out when a predetermined prize-winning symbol on any one of the reels in stopped position occurs in a prize-winning line as well as when there occurs a predetermined prize-winning combination of symbols in a bonus game which is given to players upon a specified prize-winning combination of symbols occurring in the preceding game. Although a slot machine having the function of a bonus game mentioned above is intended to provide increased chances of winning prizes for players, it is still difficult to win prizes because of the reels rotating at high speed.

OBJECT OF THE INVENTION

It is therefore an object of the present invention to provide a slot machine wherein players have an increased likelihood of winning prizes in a bonus game that immediately follows an original game.

SUMMARY OF THE INVENTION

The above object of the present invention is achieved by causing the reels to rotate at low speed in bonus games, so as to give players an increased chance to cause predetermined prize-winning combinations on the selectively stopped reels.

DETAILED DESCRIPTION OF THE INVENTION

Figure 1:
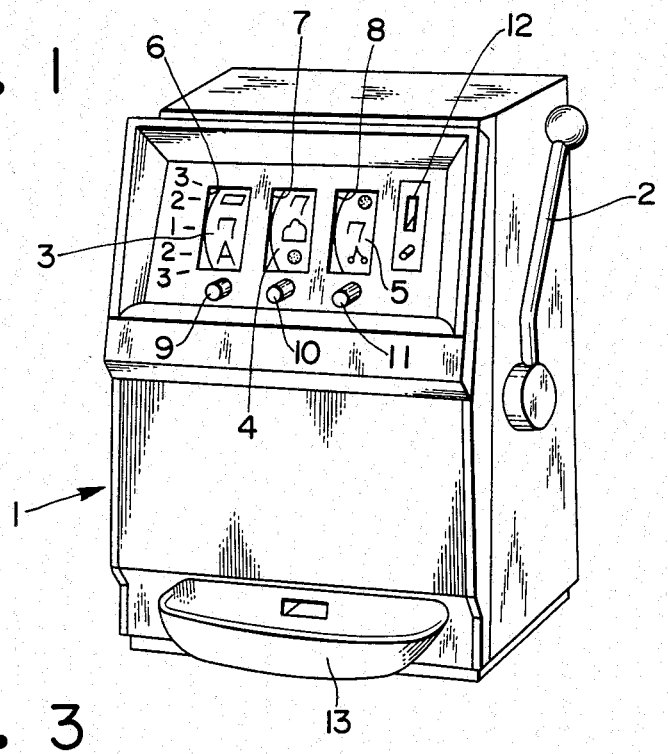
FIG. 1 is a perspective view showing a slot machine according to the invention.

Referring now to FIG. 1, there is shown a slot machine 1 wherein reels 3 to 5 are simultaneously caused to rotate by manipulation of a handle 2 on a side of a housing thereof. On the peripheral surface of the respective reels 3 to 5 is printed or otherwise provided an annular series of symbols such as pictures of a cherry, a lemon, or characters or figures such as "SKILL.-STOP", "7" or the like at regular intervals, and the symbols are visible through windows 6 to 8 associated with the respective reels 3 to 5. When a line of symbols of "SKILL.STOP" on the respective reels occurs on a transverse line or a diagonal line, players are permitted to play a bonus game in the same operation as the original game. In the bonus game, however, the respective reels are rotated at low speed, whereby desired symbols or combinations of symbols on the respective reels are liable to occur. As the predetermined combinations of symbols comprise of figures "7" or characters "BAR" on the respective reels 3 to 5 occur within the windows 6 to 8, fixed numbers of tokens are paid out as prizes. For the bonus game, it may be desirable automatically to cause the reels to rotate without tokens being put in and without manipulation of the handle 2. Otherwise, the reels may be automatically and individually caused to rotate with the introduction of tokens, one for each reel.

The respective reels 3 to 5 are individually brought to a stop by touching stop button switches 9 to 11 with a finger. Upon the introduction of tokens through a receiver 12, the slot machine will automatically release the handle which is locked by means of a magnet, allowing players to start the game. The introduction of the first token makes the central transverse line available for winning, so a predetermined number of tokens as prizes are paid out into the saucer 13 in accordance with the predetermined prize-winning combination of symbols in only the central transverse line i.e., the prize-winning line. Different numbers of prize-winning lines are made available in accordance with the number of tokens introduced. For example, if the number of tokens introduced is two or three, three transverse lines or three transverse lines and two diagonal lines are made available, respectively. It is possible to pay out prize tokens in proportion to the number of tokens which have been introduced, instead of increasing the number of winning lines. Furthermore, it is possible to provide said two ways so as to give players the choice of an increased number of prize tokens, or an increased number of winning lines. It is also possible to provide a money changing machine (not shown) on a side of the slot machine.

Figure 2:
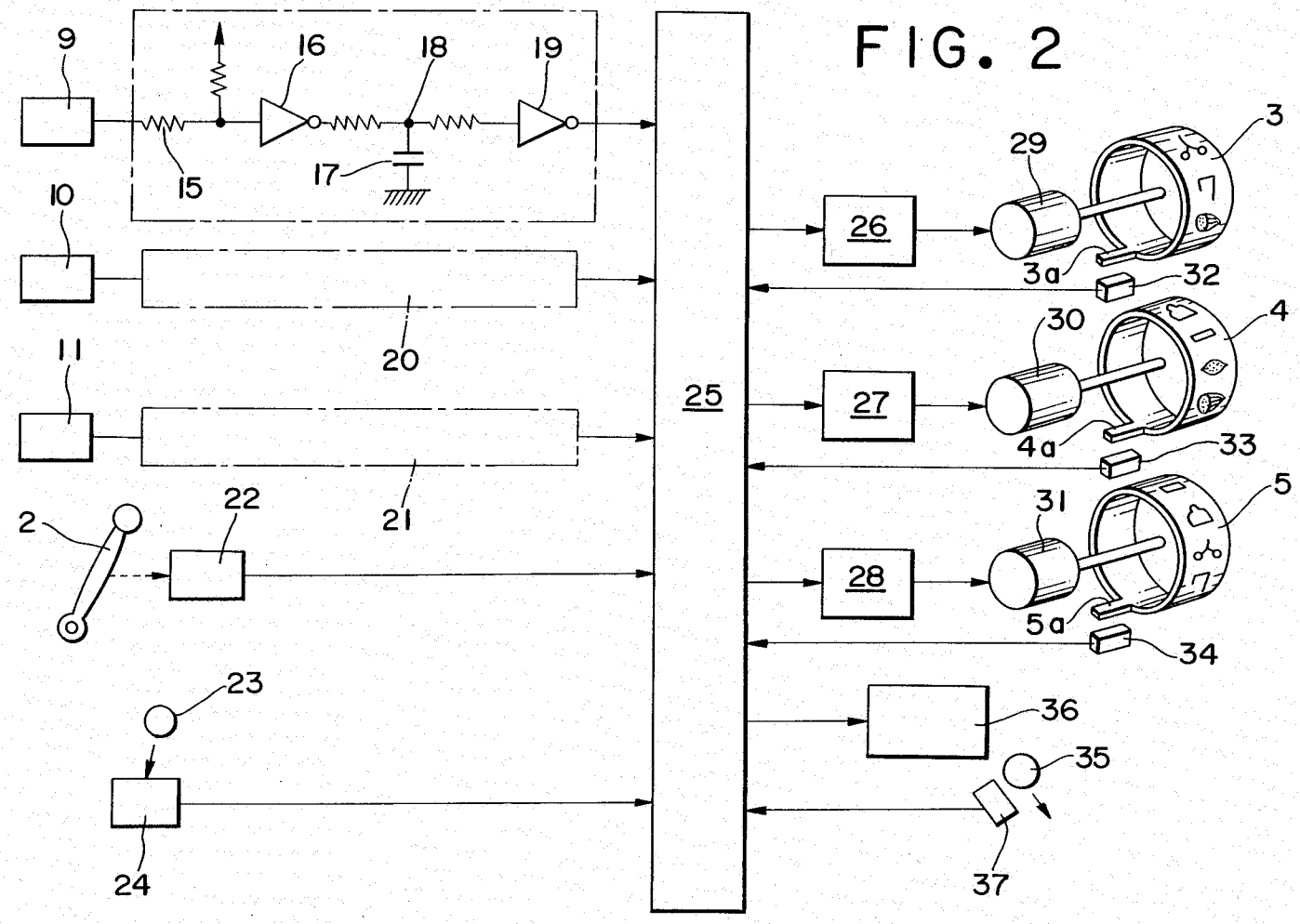
FIG. 2 is a block diagram showing the electrical circuit.

Referring to FIG. 2 showing the electrical diagram, the stop switch 9 is connected to an inverter 16 to which a high voltage is applied through a resistor 15. The inverter 16 at its output terminal is changed from "L" (low) to "H" (high) in output upon touching the stop switch 9 with a finger. At this time, a capacitor 17 is caused to charge until the voltage arising at a connection 18 reaches a predetermined voltage level. This predetermined voltage at the connection 18 causes an inverter 19 at its output terminal to change from "H" to "L". In the same way, the stop switches 10 and 11 coact with respective checking circuits 20 and 21 associated therewith. There are also provided switches 22 and 24 which are so constructed as to close upon pulling the handle 2 and upon introducing tokens 23 into the token receiver 12, respectively. It is possible to provide the start switch 22 on the housing so as to allow players directly to touch the switch 22 to start a game without manipulation of the handle 2.

A microcomputer 25 causes a solenoid to be energized when the switch 24 is closed, releasing the handle 2 to be operable, and then to allow a game program to begin upon pulling the handle 2 to close the switch 22 so as to apply pulse signals to motor control circuits 26 to 28. The motor control circuits 26 to 28 generate pulses by which pulse motors are caused to rotate, attaining a fixed speed after rapidly increasing in speed. It is to be noted that the pulse motors 29 to 31 rotate at high speed in original games but at low speed in bonus games. On the other hand, the pulses applied to the motor control circuits 26 to 28 are integrated by the microcomputer 25 itself individually, and the results associated with the respective reels are memorized individually. It is required to clear the memorized result every one revolution of each reel because of the fact that the position of the reel during rotation is detected dependent on the integrated pulses. For the purpose of responding to this requirement, there are provided light-shielding members 3*a*, 4*a* and 5*a* on the reels 3 to 5, respectively, which are detected by light-sensing means such as photo-interrupters 32 to 34 upon passing therethrough to generate signals. This aspect of the present invention is the subject of copending application Ser. No. 338,497, filed Jan. 11, 1982. The signals from the photo-interrupters 23 to 34 are fed to the microcomputer 25 to clear the previously memorized results. Said signals are generally generated at regular intervals during rotation of the reels and hence the pulse motors 29 to 31 rotate at a fixed speed. The pulse motors 29 to 31, however, sometimes rotate without synchronism, generating their respective signals at different intervals. In this case it is important to restart the pulse motors 29 to 31. This operation is previously programmed in the microcomputer 25 and thus automatically takes place upon the detection of desynchronization of the pulse motors 29 to 31.

When the stop switches 9 to 11 are pushed at random after the respective reels have reached a fixed speed, the pulse motors 29 to 31 are individually brought to a stop in dependence on the disappearance of pulses to the respective motor control circuits 26 to 28 because of stop signals from the switches applied to the microcomputer 25. It is possible to provide only one stop switch which is repeatedly pushed to stop the reels one by one. This modification (not shown) can be made by partly changing the program.

When the stop switches 9 to 11 are pushed at random to stop the reels individually, the microcomputer 25 determines which symbols are aligned on winning lines, thereby to determine whether a predetermined prize-winning combination has occurred, and if so, to cause a pay-out device, for instance a hopper 36, to pay out tokens 35 the number of which corresponds to the combination of symbols that has occurred. The tokens 35 paid out are dropped into the saucer 13 after closing a micro-switch 37 to generate signals one for every token. The signals from the micro-switch 37 are integrated to count a predetermined number of coins to be paid out.

Figure 3:
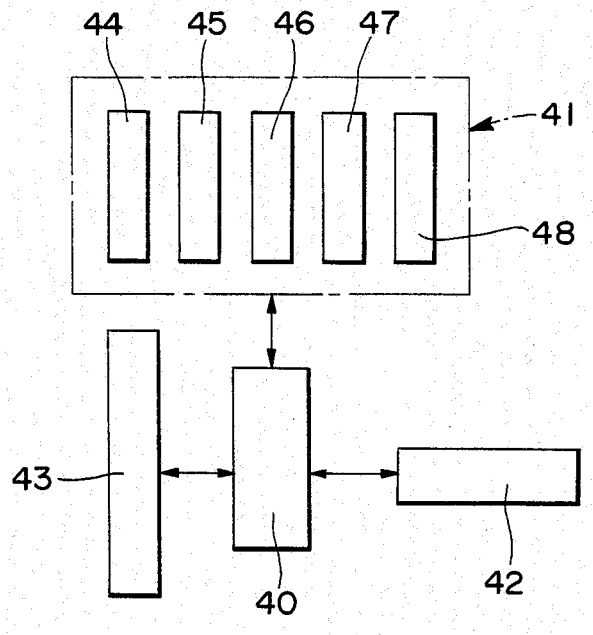
FIG. 3 is a block diagram showing the microcomputer in FIG. 2.

FIG. 3 shows the microcomputer 25 which comprises a micro-processor 40, a ROM 41, a RAM 42 and an interface 43. Said ROM 41 comprises symbol table memories 44 to 46 associated with the respective reels 3 to 5, a winning combination table memory 47 and a program memory 48. The symbol table memories 44 to 46 memorize the code signals of symbols on the respective reels 3 to 5. Therefore, by accessing the symbol table memory with a stopped position of the reels as an address signal, the code signal of the symbols occurring on the central transverse line is retrieved. The code signals of symbols occurring on transverse lines above and below the central transverse line are retrieved by accessing with signals obtained by adding one to and subtracting one from said address signal. This operation is done as follows:

The code signals of symbols on the respective reels occurring on the central transverse line can be retrieved by accessing the symbol table memories 44 to 46 with the stop position signals of the respective reels in order and then applying them to the micro-processor 40. Here, one byte is allotted for the code signal for every symbol. With the code signal of three bytes thus obtained, the winning combination table memory 47 is accessed. In this case, however, the winning combination table memory 47 may be accessed with an address signal of one byte obtained by arithmetically calculating the three-byte code signal.

The code signal of the number of tokens to be paid out, memorized in the winning combination table memory 47, is retrieved and then applied to the micro-processor 40 so as to control the hopper 36 to make the pay out. The micro-processor 40 counts the pulses from the micro-switch 37 to stop the motor for driving the hopper 36 upon a predetermined number of tokens having been paid out.

In a bonus game, detection is performed for every reel whether a predetermined prize-winning symbol on that reel has occurred; this detection is performed by accessing the winning combination table memory with code signals comprising a code signal of the symbol on the reel in question and code signals replaced by 0 (zero, in the decimal system) for symbols on the other two reels.

The program memory 48 includes a game program and the RAM 42 memorizes the number of tokens introduced in the slot machine and the numbers of pulses for driving the pulse motors 29 to 31.

Figure 4:
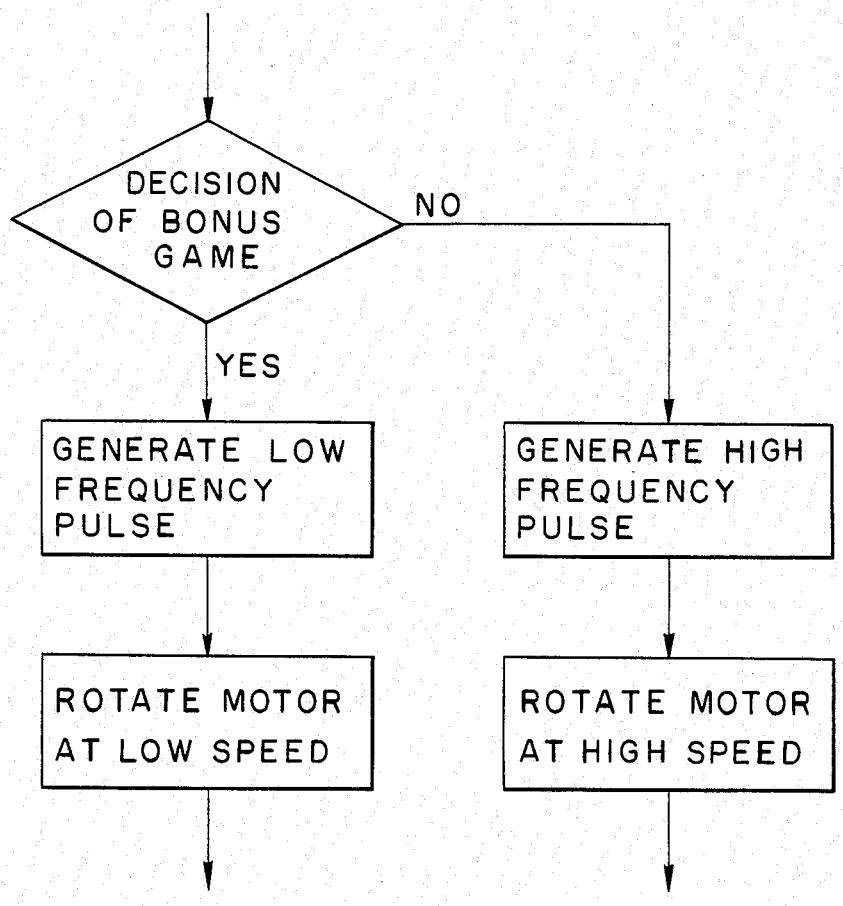
FIG. 4 is a flow chart showing the program of pulse motor driving.

FIG. 4 is a flow chart showing the program of pulse motor driving. The microcomputer 25 memorizes the combination of symbols occurring on the reels in their stopped position to detect whether the occurred combination coincides with a predetermined bonus game winning combination, and if so, to generate, in the program control, pulses of low frequency. On the other hand, if it does not coincide with a predetermined bonus game winning combination, pulses of high frequency are generated. Such pulses can be generated by using a conventional microcomputer controlled pulse generator such as a VCO or the like.

A further understanding of the operation of the slot machine of the invention will be had from the following description:

The operation of the slot machine is initiated by manipulation of the handle 2 after the introduction of a token or tokens. The pulse motors 29 to 31 are caused to rotate by driving circuits 26 to 28, respectively, to which pulses are applied from the microcomputer 25, and attain a fixed speed after rapidly increasing in speed. Upon pushing the stop switches 9 to 11 at random, the pulse motors 29 to 31, i.e. the reels 3 to 5, are brought to a stop individually. The microcomputer 25 detects whether a predetermined combination of symbols in the windows 6 to 8 has occurred, and if so, determines the number of tokens 35 to be paid out as prizes from the hopper 36, corresponding to the prize-winning combination of symbols.

When the combination of symbols of "SKILL.-STOP" on the respective reels in stopped position occurs in a specified transverse line in an original game, an additional game, i.e., a bonus game, is given to the player. In the bonus game, the symbols on the respective reels in rotation can be observed distinctly by the players because the respective pulse motors, i.e. the respective reels, rotate at low speed. Therefore, players can stop the reels individually upon observing the symbols, so as to try to stop prize-winning symbols in the windows. In a bonus game, which allows players to stop the reels individually, a predetermined number of tokens are paid out for every reel whenever a predetermined prize-winning symbol such as characters of "BAR" or specific symbols on the respective reel in stopped position occurs in the central transverse line. The slot machine of the invention, however, can be modified so as to cause the pay out of a fixed number of tokens upon a predetermined prize-winning combination of symbols on the respective reels in stopped position occurring in specified lines in a bonus game as in original games. Furthermore, it is of course possible to pay out prize tokens in proportion to the number of tokens which have been inserted.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a slot machine having a plurality of rotatable reels arranged in side-by-side relationship, a plurality of stop switches associated with each of said reels for causing said reels individually to stop, each reel having an annular series of symbols on the peripheral surface thereof, and motors one individual to each said reel for rotating said reels; the improvement comprising means for the detection of the occurrence of a predetermined symbol or combination of symbols on said reels in the stopped position of said reels in the course of an original game and for emitting a bonus game signal responsive to a said detection to entitle a player to a bonus game immediately following said original game, motor control circuits driving said motors at high speed in a said original game, and means responsive to a said bonus game signal automatically to cause said motor control circuits to drive said motors at low speed in a said bonus game.

2. A slot machine as defined in claim 1, said motors being pulse motors.

* * * * *